United States Patent [19]

Vidal

[11] 4,141,184

[45] Feb. 27, 1979

[54] TERRACED DWELLINGS

[76] Inventor: Henri C. Vidal, Tour Horizon 52, quai Nationale, 92806 Puteaux, France

[21] Appl. No.: 823,164

[22] Filed: Aug. 9, 1977

[51] Int. Cl.[2] ..... E02D 21/01

[52] U.S. Cl. ..... 52/169.4; 52/79.2; 52/742

[58] Field of Search ..... 52/79.2, 79.3, 169.1, 52/169.2, 169.3, 169.4, 169.6, 236.4, 293, 742; 61/39, 49, 41

[56] References Cited

U.S. PATENT DOCUMENTS

| | | | |
|---|---|---|---|
| 2,100,451 | 11/1937 | Parkhurst | 52/293 |
| 2,241,830 | 5/1941 | Tourtellotte | 52/169.4 |
| 3,724,147 | 4/1973 | Levenson | 52/79.2 |
| 3,791,081 | 2/1974 | Felciai | 52/79.2 |

FOREIGN PATENT DOCUMENTS

| | | | |
|---|---|---|---|
| 1469466 | 2/1967 | France | 52/169.3 |
| 65287 | 5/1942 | Norway | 52/169.4 |
| 397492 | 8/1933 | United Kingdom | 61/39 |
| 520399 | 4/1940 | United Kingdom | 52/169.6 |
| 792074 | 3/1958 | United Kingdom | 52/169.6 |
| 1034101 | 6/1966 | United Kingdom | 52/236.4 |

OTHER PUBLICATIONS

Earth Form House from Architectural Record, May 1976, pp. 106 and 107.

*Primary Examiner*—Ernest R. Purser
*Assistant Examiner*—Henry Raduazo
*Attorney, Agent, or Firm*—Burns, Doane, Swecker & Mathis

[57] ABSTRACT

A multi-dwelling structure is disclosed in which dwellings are arranged on terraces. The structure may be constructed on steep hill sides, or a hill may be built up from earth brought to the site. Preferably, one of the walls of the dwellings is formed of rigid upright panels with pliable reinforcing members secured to the panels and extending rearwardly into the earth to consolidate the earth particles. In the alternative, one of the walls of the dwellings may be formed of concrete cast in situ. The arrangement of the dwellings in the structure provides privacy and extensive areas for growing plants and trees.

20 Claims, 14 Drawing Figures

FIG. 6
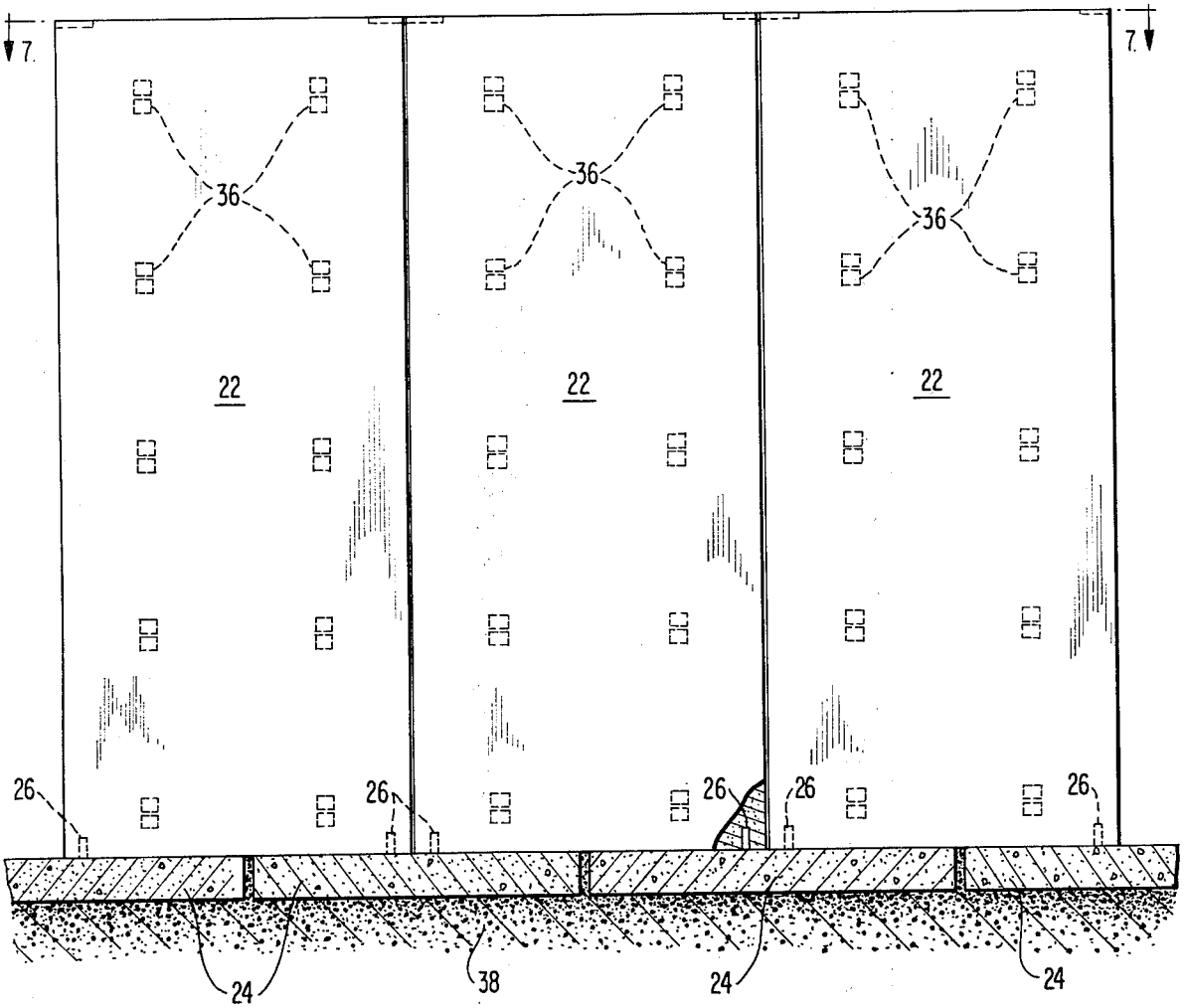
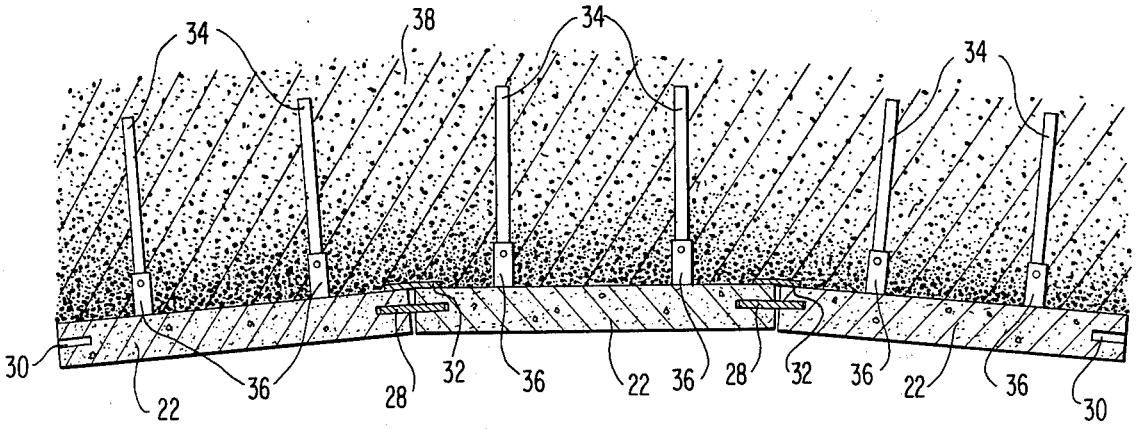
FIG. 7

FIG. 11
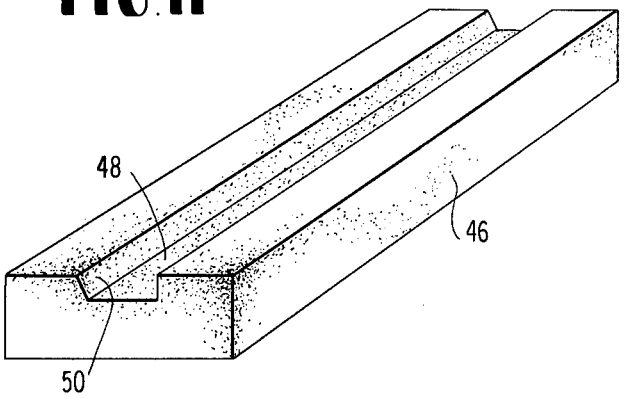
FIG. 12
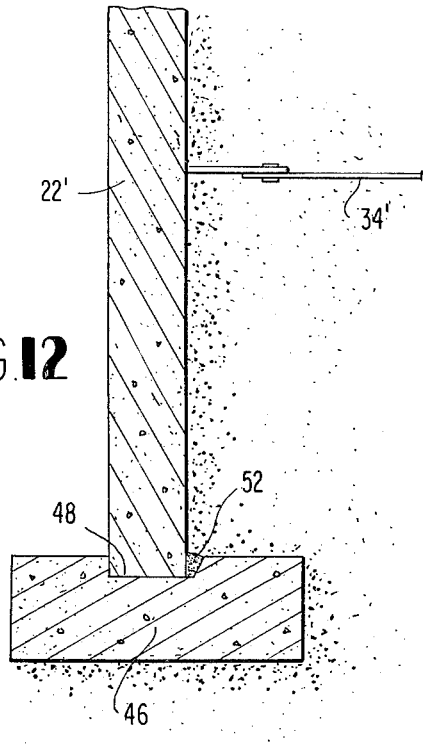
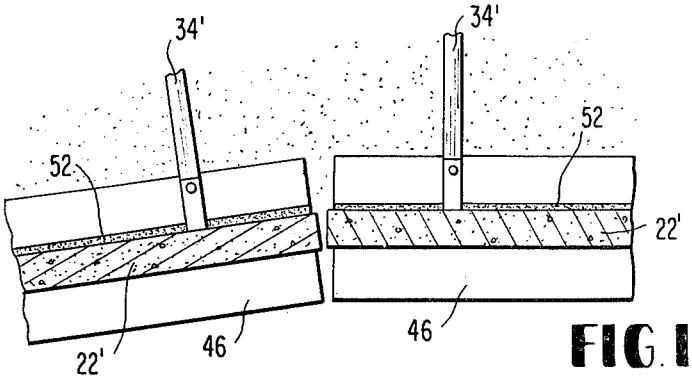
FIG. 13
FIG. 14
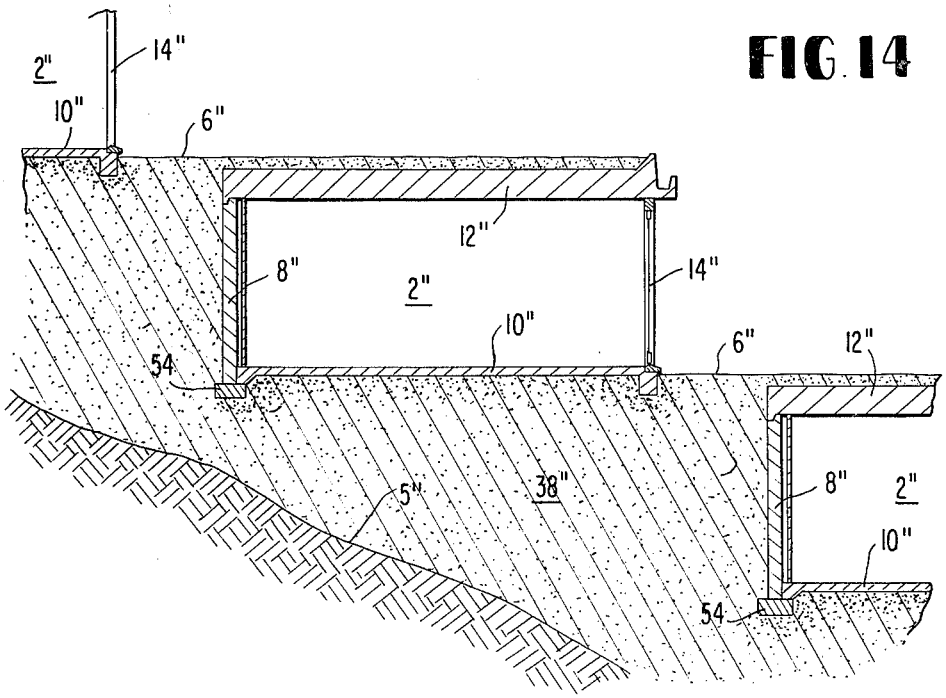

TERRACED DWELLINGS

This invention relates to building structures, and more particularly, to residential housing in a terraced arrangement It has been common practice to construct multi-story apartment buildings in order to obtain maximum utilization of land, particularly at locations where the view of the surrounding terrain enhances the value of the property. The disadvantage of multi-story apartment buildings is that the occupants of the upper floors are far removed from the surface of the ground, and access to the outside is provided only by narrow balconies at the level of the occupant's apartment. Because the occupants of such a building share many common areas, such as hallways, elevators, parking lots and a common entrance and exit, there is very little sense of privacy and individuality among the occupants of the building.

In other areas, the terrain is relatively flat. Multi-story apartment buildings which are commonly built in such areas tend to project upward from the ground, so that many of such buildings give an impression of conjestion and crowded living conditions which are unpleasant for the inhabitants. Prior attempts to blend the housing into the flat terrain have had the disadvantage of reducing the density of population so that each dwelling unit becomes excessively expensive, or greatly expands the area required so that the buildings are spread apart and create traffic congestion with many dwellings located far from the most desirable location.

There are also many sites that are suitable, and highly desirable for housing, but unacceptable because of poor soils, or because the terrain is too steep for the construction of economical housing.

I have previously developed a system for constructing retaining walls and other structures, as described in my U.S. Pat. Nos. 3,421,326 and 3,686,873. Furthermore, I have suggested that my technique can be utilized to construct terraces on several levels, and to build dwelling units on the horizontal surface of each terrace. This concept is disclosed, for example, in my French Pat. No. 72.01591 and in Annales De L'Institut Technique Du Batiment Et Des Trauvaux Publics Supp. No. 299 November 1972. Neither my prior patents nor my publications, however, have disclosed a practical arrangement for a multi-dwelling structure in a hill formed at least partially of non-cohesive earth.

SUMMARY OF THE INVENTION

This invention relates to a multi-dwelling structure in which the dwellings are arranged in terraces. Preferably, the multi-dwelling structure of this invention is arranged in a community with terraces formed by portions of the wall of each dwelling and earth is superimposed on the roof of the dwelling in the next lower terrace. The exposed side of the dwelling includes an entrance and windows, and the earth covering the roof of the dwelling on the next lower terrace level serves as a patio in front of the exposed wall of the upper dwelling. Plants and trees are arranged in the earth around the dwellings to screen one from another, and the terraces provide a visual and physical separation between the dwellings, both vertically and laterally.

A retaining wall for the next higher terrace level serves as an interior wall of the dwelling. Preferably, the interior wall includes a plurality of rigid panels extending substantially upright and arranged side-by-side. The panels extend continuously from adjacent the floor to adjacent the roof of the structure. On the rear side of the wall, a plurality of reinforcing members extend outwardly into the earth that is retained behind the wall. The reinforcing members are spaced apart vertically and horizontally and extend generally perpendicular to the face of the wall. The earth which is of a particulate material, is interspersed and compacted between and around the reinforcing members through substantially the entire height of the walls panels. The roof of the structure rests directly on the top of the panels and is supported thereby.

Instead of constructing the retaining walls with the panels, as described above, the walls may be formed of concrete cast in situ. The terraces may be constructed with earth fill on existing sloping terrain, including steep hillsides, or the terraces may be constructed on relatively flat terrain by using earth fill to build a large mound.

DESCRIPTION OF PREFERRED EMBODIMENT

A preferred embodiment of this invention is illustrated in the accompanying drawing in which:

FIG. 6 is a cross-sectional view of the rear wall of the dwelling along the line 6—6 in FIG. 3;

FIG. 7 is a cross-sectional view of the rear wall along the line 7—7 in FIG. 6;

FIG. 11 is a perspective view of a modified panel block of FIG. 10;

FIG. 12 is a cross-sectional view of the modified wall along the line 12—12 in FIG. 10;

FIG. 13 is an enlarged cross-sectional view of the modified panels and blocks as in FIG. 10; and FIG. 14 is a cross-sectional view of the community as in FIG. 3, but showing a second modified form of the invention.

Figure 1:
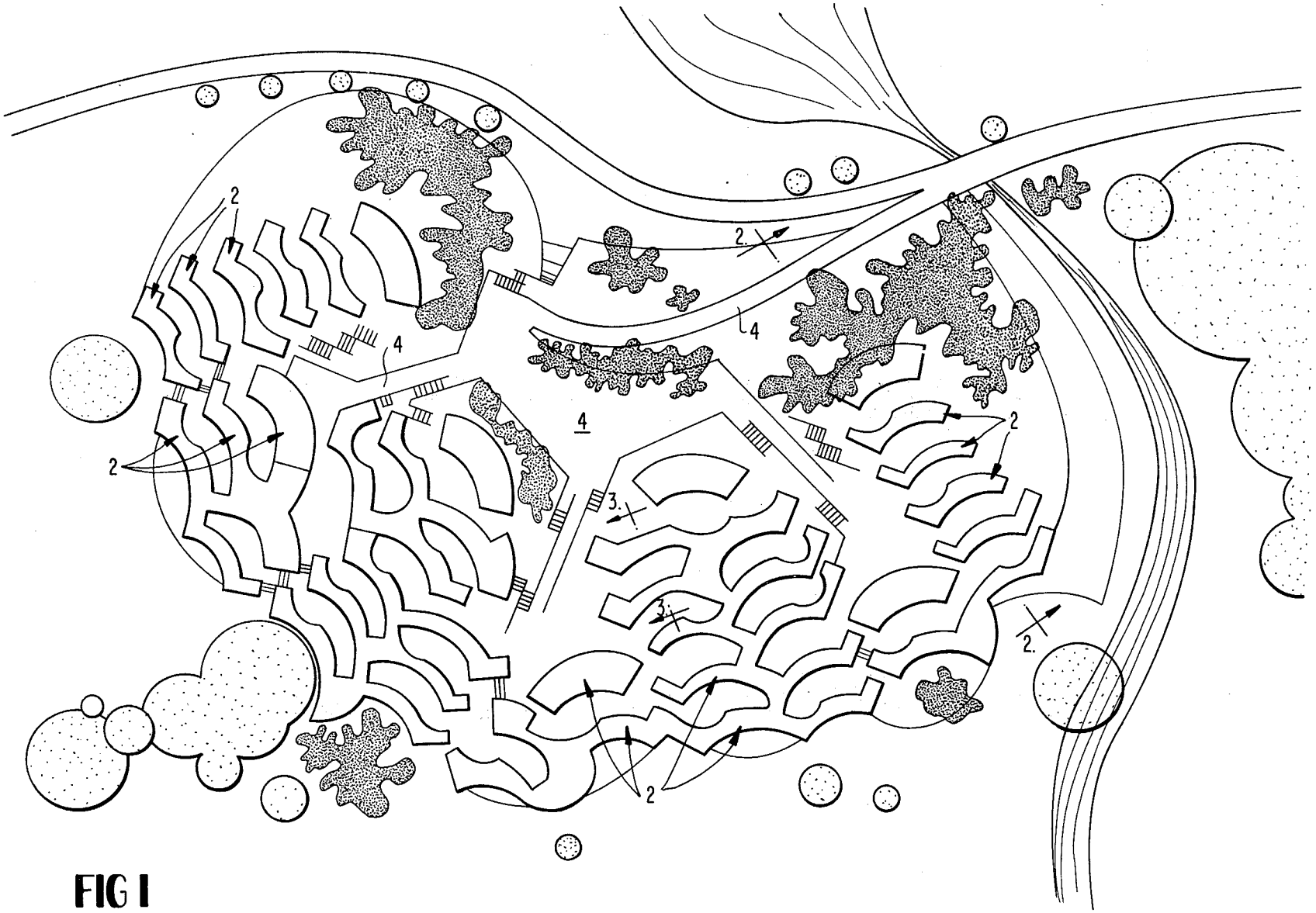
FIG. 1 is a top plan view, partially schematic, of a housing community incorporating the building structures of this invention.
Figure 2:
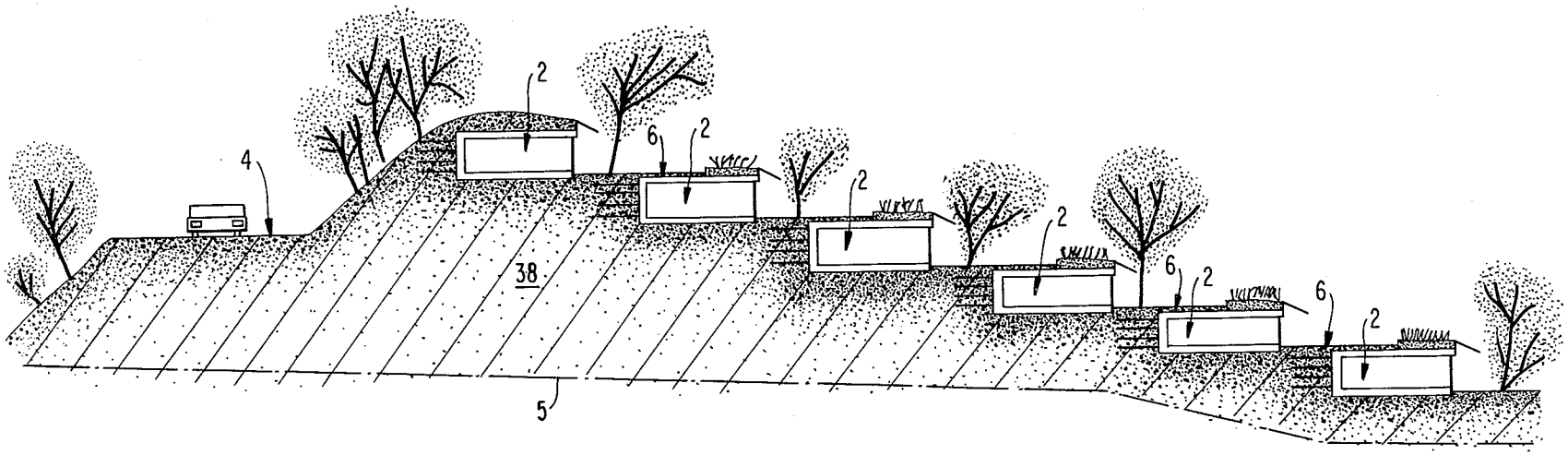
FIG. 2 is a cross-sectional view of the community along the line 2—2 in FIG. 1.

A typical community constructed in accordance with this invention is shown in FIGS. 1 and 2. The dwelling units 2 are arranged on terraces as shown in FIG. 2. The dwellings 2 may be arranged in a single row as shown at the right and left ends in FIG. 1, or may be arranged side-by-side on the various levels of the terraces as shown in the middle of FIG. 1. The community arrangement in FIG. 1 is designed to allow the dwellings to overlook the terrain on two sides of the community. The other two sides, at the top of FIG. 1 do not contain dwelling units, but provide roadways 4 for access to the dwellings. Of course, the community can be designed to permit dwellings to be positioned on all sides of the community, if desired.

An important feature of this method of construction is that the community can be constructed economically on relatively level terrain. For example, the natural surface of the ground prior to construction is shown schematically at 5 in FIG. 2. Earth fill 38 is brought to the site and deposited on the ground to form an earth mass which serves as a base for the elevated community, including dwellings 2, roadways 4 and terraces 6. The earth fill 38 is a substantially particulate material having good drainage and load supporting properties. If the natural ground surface is sloping, it is nevertheless preferable to superimpose earth fill 38 on the surface of the ground to construct the dwellings without requiring excavating.

Figure 3:
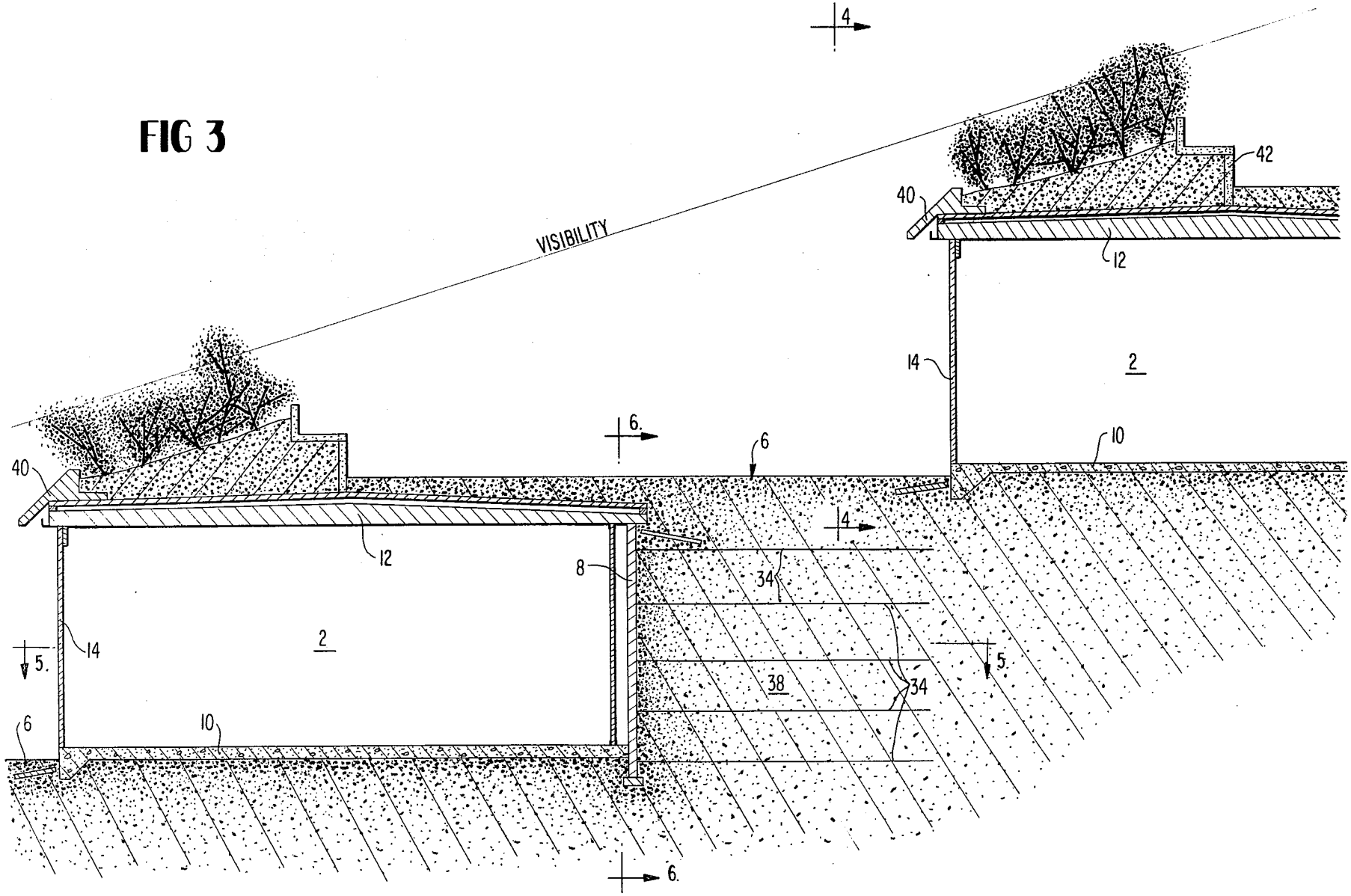
FIG. 3 is an enlarged cross-sectional view of the building structure along the line 3—3 in FIG. 1.
Figure 4:
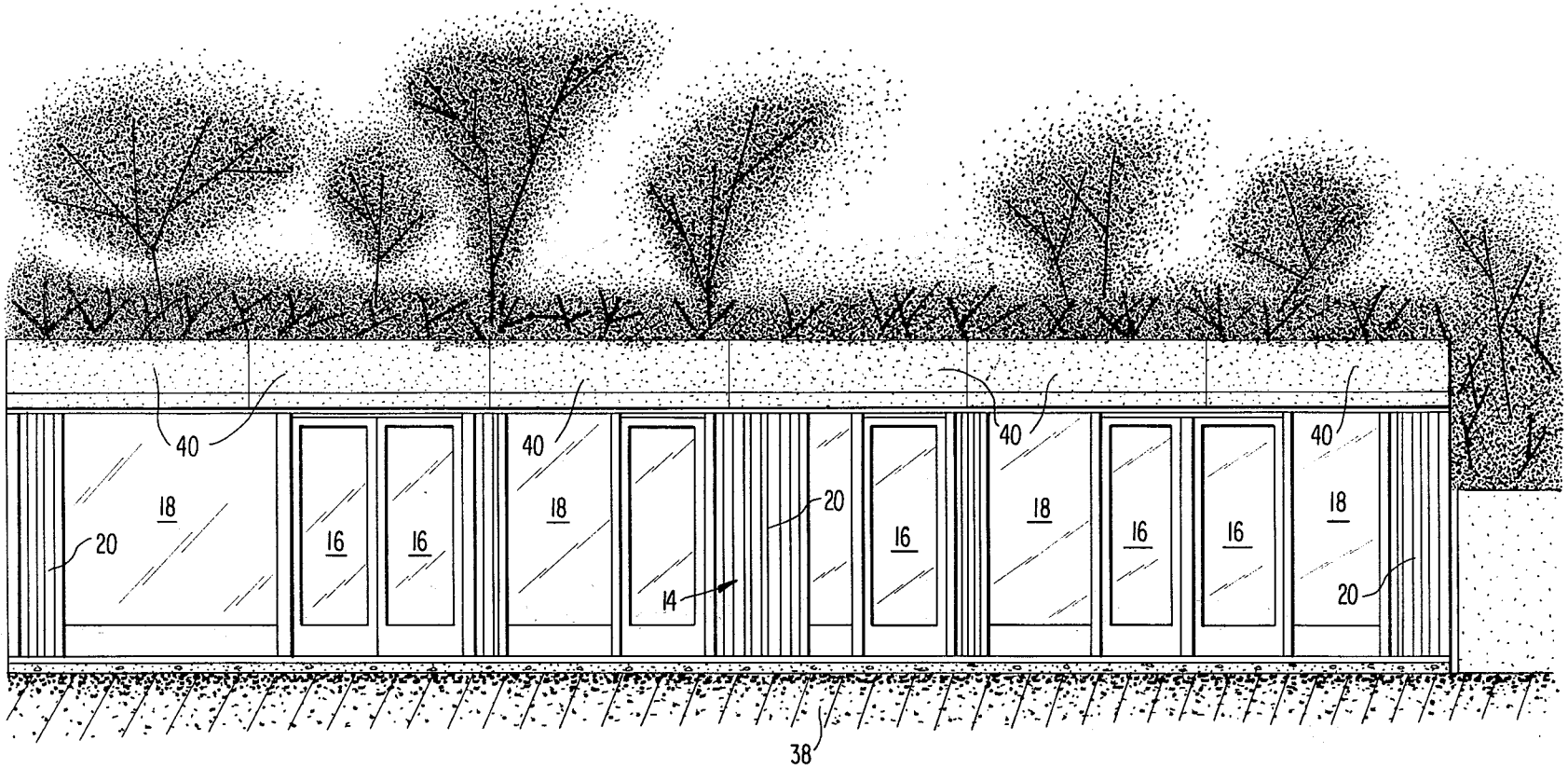
FIG. 4 is a front elevational view, partially in cross-section, along the line 4—4 in FIG. 3.

As shown in FIGS. 2 and 3, the dwellings 2 are arranged on the horizontal areas which form the terraces 6. Each dwelling 2 includes a rear wall 8, a floor 10 and a roof 12. The rear wall 8 may extend around the interior of the dwelling along the sides and join with the front wall structure 14. A typical front wall 14 is shown in FIG. 4, and may include doors 16 and windows 18 with louvers or blinds 20.

Figure 5:
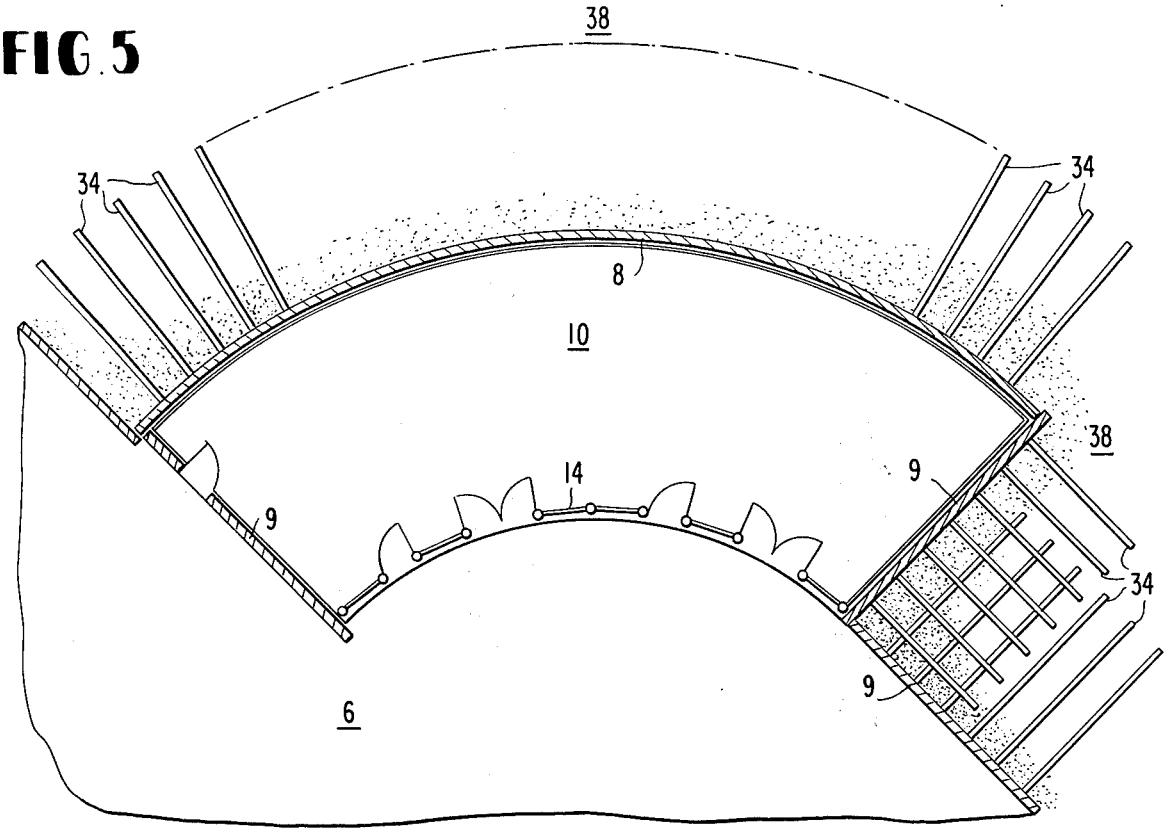
FIG. 5 is a cross-sectional view of the structure in a reduced scale along the line 5—5 in FIG. 3.

The rear wall 8, according to one embodiment, includes a plurality of rigid concrete panels 22, as shown in FIG. 6. The rear wall 8 and the front wall 14 preferably are arcuate, and the side walls 9 are straight. The panels 22 are supported at the base by concrete blocks 24. Each of the blocks has an upright alignment pin 26 which is cast in the block. Each of the panels 22 has a corresponding socket, preferably with a ferrule in the socket to receive the pin 26 so that the pin prevents lateral displacement of the panel from the blocks 24. As shown in FIGS. 5 and 7, the panels 22 are preferably arranged in angular relation to each other to provide a curvature to the wall 8. Similarly, the blocks 24 are set at an angle to each other to accomodate the curvature.

Figure 8:
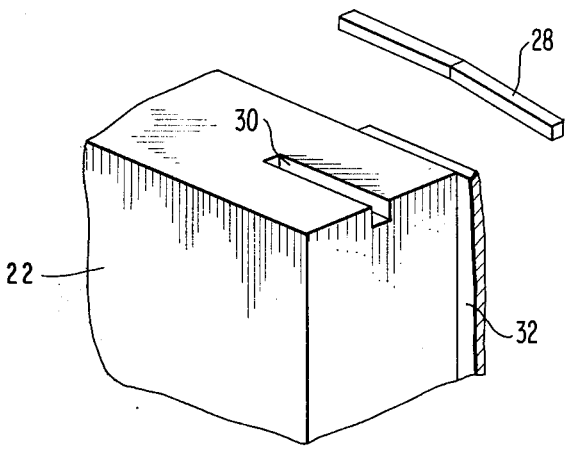
FIG. 8 is a detail view of the joint at the top of the rear wall.
Figure 9:
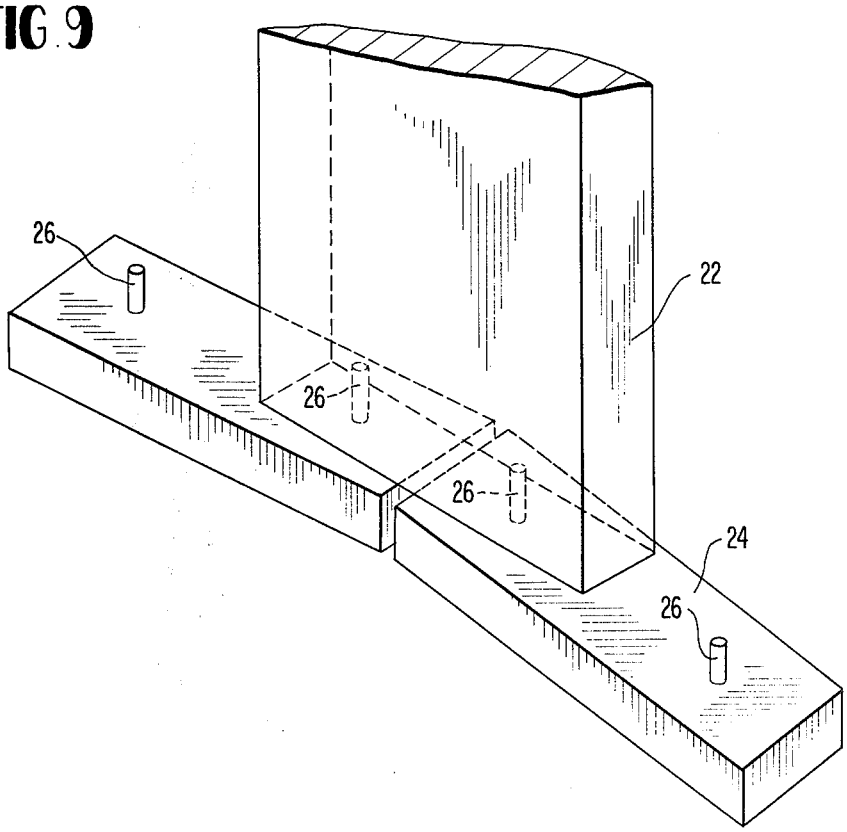
FIG. 9 is a detail view of the rear wall base.

At the top of the panels 22, adjacent panels are secured together in a predetermined angular relation by a key 28 (FIG. 8) which is received in corresponding slots 30 in the panels 22. The key 28 is bent approximately midway of its length to correspond to the predetermined angle between adjacent panels. The joint between the panels may be sealed with suitable filler materials such as tar or polystyrene, and preferably a wide tape 32 is applied over the joint at the rear side of the wall. The arrangement for the straight walls 9 is essentially the same as that of the curved wall 8, except that the keys 28 are straight and the panels 22 and blocks 24 are aligned.

As shown in FIGS. 3 and 7, a plurality of reinforcing members 34 are secured to the rear side of the panels 22 by means of brackets 36 which are cast in the panels. These reinforcing members 34 are in the form of thin, flexible strips capable of sustaining tension, as defined in greater detail in my U.S. Pat. No. 3,421,326. Earth particles 38 fill the space between the reinforcing members throughout substantially the entire height of the panels 22, as described in my patent. As a result of the frictional engagement between the earth particles and the reinforcing members, the earth behind the rear wall 8 is stabilized and provides support for the next higher terrace 6. The rear wall 8 serves as a cladding for retaining the earth particles adjacent the rear face of the wall.

The floor of the dwelling is preferably formed of a concrete slab which is poured after the wall 8 is constructed so that the edge of the slab abuts against the curved wall surface formed by the panels 22. A conventional joint seal is preferably provided between the face of the panel and the floor slab 10. The earth 38 under the slab 10 preferably is of a particulate nature and extends continuously under the floor 10 and throughout the area surrounding the reinforcing members 34 behind the wall 8. The depth of the particulate earth 38 placed under the slab is preferably one meter. Also, the earth 38 under the slab 10 and between the reinforcing members 34 should be uniformly compacted to avoid settling.

The roof 12 preferably is formed by a concrete slab which rests directly on the top edge of the panels 22. The roof 12 may also be partially supported by a front wall 14. The weight of the roof is supported directly by the panels 22 and by the blocks 24. The earth under the blocks 24 is sufficiently compacted to avoid vertical movement of the panels 22. In accordance with conventional practice, the roof 12 may be precast in a thin slab with the remainder of the slab being poured at the site after the roof is in position.

At the front of the dwelling 2, directly over the wall 14, a plurality of precast blocks are superimposed on the roof 12. These blocks cooperate with an upright wall 42 to form a planter 44. The blocks 40 also extend over the wall 14 to deflect rain away from the wall. The planter 44 screens the upper terrace level 6 from the terrace of the next lower level.

The shape of the dwellings 2 may be varied by changing the curvature of the wall 8 and the orientation of the front wall 14 relative to the ground. As shown in FIG. 1, a variety of arrangements of the dwellings 2 may be provided according to the requirements of the community.

The community is quickly and efficiently constructed by depositing a mass of the particulate material 38 on the natural ground surface 5 (FIG. 2). The mass is contoured by conventional grading techniques to provide a plurality of substantially horizontal areas 6 which are spaced apart both vertically and horizontally from each other. The wall 8 is constructed by placing the footing block 24 on the material 38 after compacting the material. The panels 22 are then installed as shown in FIGS. 6 and 7, with the material 38 being filled and compacted in layers alternating with the reinforcing members 34. The floor 10 is applied over the material, and is preferable in the form of a slab of concrete. The front wall structure 14 is installed at the front of the slab. The roof 14 is then placed on the top of the wall 8, as previously explained, and covered by the material 38 to form a terrace above the roof 14 and in front of the front wall structure of the next higher area 6.

Figure 10:
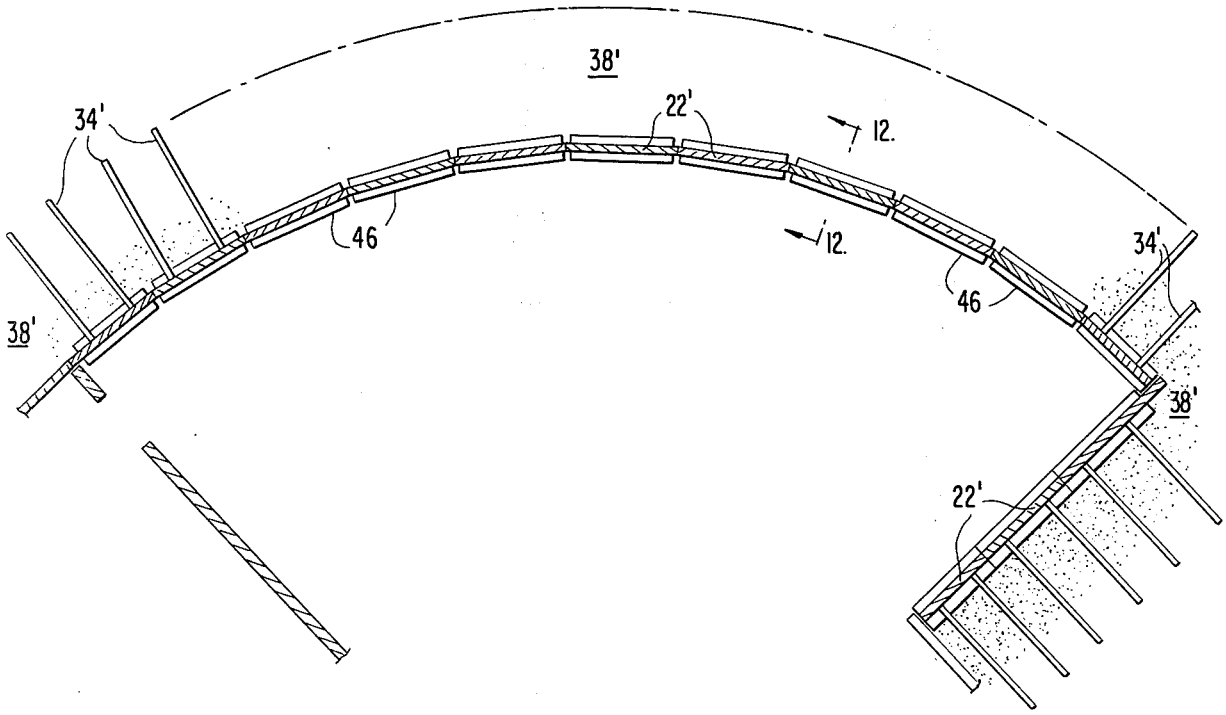
FIG. 10 is a cross-sectional view as in FIG. 5, but showing a modified form of the invention.

A modified form of the walls 8 and 9 is shown in FIGS. 10–12. In this form of the invention, the panels 22' are of substantially the same configuration as the panels 22 shown in FIGS. 6,7. Each of the panels 22' has reinforcing members 34' secured to the rear side of the panels to consolidate the earth fill 38'. The panels 22' are supported on precast blocks 46 which have a longitudinal slot 48 to receive the panels. The rear side 50 of the slot 48 slopes rearwardly (FIGS. 11 and 12) to provide a groove in which a moisture sealing material 52 is applied. Each panel 22' rests on a single block 46, and extends slightly beyond the end of the block to abut against the adjacent panel 22'. A suitable sealant is applied to the rear side of the joint.

Another alternative is illustrated in FIG. 14. In this form of the invention, the wall 8'' is concrete that is cast in situ. The natural ground surface 5'' is shown to slope, although it may also be more level, as in FIG. 2. The mass of particulate material 38'' is superimposed on the surface 5'', as previously described, and contoured to form horizontal areas 6''. The dwelling 2'' include the wall 8'' at the rear edge portion of the areas 6''. A footing 54 is placed on the compacted material 38'' and may be precast, or cast, in situ. The floor slab 10'' is also applied over the compacted material 38''. Preferably, the rear edge of the slab 10'' is also supported on the footing. The roof 12'' rests on the wall 8'' and on the front wall structure 14'' of the dwelling, and is covered with material 38'' to form a terrace in front of the front structure 14'' of the next higher area 6''.

In accordance with conventional practice, the concrete in the wall 8'' should be reinforced adequately to withstand the loads bearing on the wall. Of course, the wall 8'' may be formed of any other suitable wall construction, provided that the wall is sufficiently rigid to support the roof without substantial deflection.

While this invention has been illustrated and described in relation to a preferred embodiment, it is recognized that variations and changes may be made therein without departing from the invention as set forth in the claims.

What is claimed is:

1. A housing structure comprising a mass of substantially particulate material superimposed on the surface of the earth, said material being arranged to provide terrace levels each having a front edge portion and a rear edge portion, a plurality of dwellings being arranged separately on said terrace levels, said dwelling on one of said levels including a retaining wall extending along said rear edge portion and including a roof resting directly on and supported by said wall, the dwelling of the next higher terrace level including a floor and a front wall, said floor being spaced above the roof of the dwelling on the next lower level and said front wall being spaced rearwardly of said rear wall of said next lower level, said particulate material substantially filling the space between said roof and said floor of the next higher level, and said rear wall being positioned to retain said material.

2. The housing structure according to claim 1 wherein said rear wall includes a plurality of rigid panels extending substantially upright and arranged side by side, said panels extending continuously from adjacent the floor of said dwelling to said roof.

3. The housing structure according to claim 2 wherein said wall includes a plurality of elongated reinforcing members extending outwardly from the exterior side of said panels at vertically spaced intervals, and wherein said mass of particulate material is interspersed and compacted between and around said reinforcing members throughout substantially the entire height of said panels.

4. A multi-level building structure comprising a plurality of dwellings, said dwellings having an exterior wall and a roof and a floor;

a first one of said dwellings having a floor superimposed on a mass of particles and a second one of said dwellings being adjacent to said first dwelling and at a higher level, said second dwelling having a floor superimposed on said mass of particles;

said first and second dwellings each having a portion of said exterior wall at the rear of said dwelling, said rear wall portions being substantially rigid and extending from adjacent the floor to adjacent the roof of the respective first and second dwellings;

said floor of said second dwelling being at an elevation above the roof of said first dwelling and being spaced rearwardly of said rear wall portion of said first dwelling, said particles substantially filling the space between said first dwelling and said second dwelling, whereby said first and second dwellings are arranged in a terraced relation.

5. The multi-level building structure according to claim 4 wherein said rear wall portion of at least one of the dwellings includes a plurality of rigid panels, said rear wall portion also having a plurality of elongated pliable reinforcing members extending rearwardly from said panels in said mass of particles, said reinforcing members being connected with said panels, and being spaced apart vertically throughout substantially the entire height of said panels.

6. The multi-level building structure according to claim 4 wherein said dwellings include a front wall and a terrace extending outwardly from said front wall, said terrace of one dwelling overlying at least a portion of the roof of the dwelling at the next lower dwelling.

7. The multi-level building structure according to claim 5 wherein said rigid panels are formed of precast concrete and said structure includes footing means supporting said panels.

8. The multi-level building structure according to claim 7 wherein said roof of said dwellings is in direct engagement with said panels and supported thereby.

9. The multi-level building structure according to claim 7 wherein said footing means includes a plurality of footing blocks underlying said panels, said blocks including means cooperating with panels to prevent displacement of said panels relative to said blocks, and including means for maintaining alignment between said panels.

10. The multi-level building structure according to claim 9 wherein said footing blocks have a longitudinal slot for receiving the bottom edge of said panels, and including sealant material interposed between said panel and said block along said slot.

11. The multi-level building structure according to claim 9 wherein said cooperating means includes a socket in either said block or said panel and a pin in the other.

12. A method for constructing on a natural ground a residential community having separate dwellings of the type having a floor, exterior walls and a roof, said method comprising the following steps:

(a) depositing on the natural ground surface a mass of substantially particulate material having draining and load supporting properties, said mass having a generally sloping upper surface;

(b) shaping and compacting the upper surface of said mass so as to delineate a plurality of substantially horizontal areas, said areas being vertically and horizontally spaced from each other and each having a front edge portion and a rear edge portion;

(c) building a generally vertical wall adjacent to said rear edge portion of each area, the upper edge of said wall being lower than the level of the next higher horizontal area;

(d) applying a floor directly on the compacted material of each area, said floor extending from said wall toward said front edge portion;

(e) erecting a front structure on the floor;

(f) connecting between said wall and said front structure a roof member of generally flat shape; and (g) depositing said substantially particulate material on said roof member up to the level of the next higher horizontal area, whereby in front of each dwelling can be provided a terrace extending over the roof of the dwelling on the next lower horizontal area.

13. The method according to claim 12 wherein said wall building step includes placing prefabricated blocks along the base of said wall, and supporting a plurality of rigid wall panels on said blocks to form said wall.

14. The method according to claim 13 wherein said wall building step includes securing a plurality of elongated reinforcing members capable of sustaining tension on the rear side of said panels, said members being arranged in a series of horizontal layers with members in each layer extending side by side from the panels, said layers being spaced apart vertically, and includes placing layers of said particulate material in alternating relation with said layers of reinforcing members.

15. The method according to claim 12 wherein said wall building step includes casting said wall of concrete in situ.

16. The method according to claim 13 wherein said floor applying step includes casting said floor of concrete to form a slab bearing on said blocks.

17. A residential community having separate dwellings of the type having a floor, exterior walls and a roof, said community comprising:

a mass of a substantially particulate material having draining and load supporting properties superimposed on the natural ground and having a generally sloping surface, the surface of said mass being shaped to provide a plurality of horizontal areas vertically and horizontally spaced from each other and each having a front edge portion and a rear edge portion;

a generally vertical wall adjacent to said rear edge portion in each of said areas, the top of said wall being lower than the level of the next higher horizontal area;

a floor superimposed on said material of said horizontal areas and extending from adjacent said wall toward but spaced from said front edge portion;

a front structure; and a roof member superimposed on said wall and said front structure of each of said areas, said roof member being substantially flat and being covered by a layer of said particulate material, whereby the roof of the next lower horizontal area forms a terrace in front of the front structure of the upper area.

18. The residential community according to claim 17 wherein said wall includes a footing and an assembly of panels arranged side by side and supported on said footing, a plurality of elongated reinforcing members secured to said panels and extending rearwardly into said mass to consolidate said mass.

19. The residential community according to claim 18 wherein said level of said next higher horizontal area includes a floor superimposed on said material, said floor of said next higher level being separated from said roof member by said particulate material.

20. The residential community according to claim 19 wherein said level of said next higher level includes a front structure spaced rearwardly from said front edge portion, and said front structure of said next higher horizontal area being spaced rearwardly from the wall of said next lower horizontal area.

* * * * *